United States Patent [19]

Breedijk

[11] 3,960,615

[45] June 1, 1976

[54] WELDABLE BAR, ESPECIALLY FOR USE IN REINFORCING CONCRETE

[75] Inventor: Theo Breedijk, Heemskerk, Netherlands

[73] Assignee: Hoogovens Ijmuiden, B.V., Ijmuiden, Netherlands

[22] Filed: Apr. 11, 1974

[21] Appl. No.: 459,933

[30] Foreign Application Priority Data

Apr. 16, 1973 Netherlands ..... 7305262

[52] U.S. Cl. ..... 148/36; 29/193; 75/123 J; 75/123 N

[51] Int. Cl.[2] ..... C22C 39/26; C22C 39/54

[58] Field of Search ..... 75/123 N, 123 J; 29/193; 148/36

[56] References Cited

UNITED STATES PATENTS 3,102,831 9/1963 Tisdale ..... 148/12

3,725,049 4/1973 Satoh et al. ..... 75/123 D

*Primary Examiner*—L. Dewayne Rutledge
*Assistant Examiner*—E. L. Weise
*Attorney, Agent, or Firm*—Stevens, Davis, Miller & Mosher

[57] ABSTRACT

A new Si-semi-killed BOF steel, especially suitable for use in the form of bar for concrete reinforcements in which the bar is stitch-welded, contains not less than 0.18% and not more than 0.29% C, not less than 1.20% and not more than 1.50% Mn, less than 0.1% Si, less than 0.01% Al, less than 0.005% N, less than 0.05% P, less than 0.05% S, in total less than 0.15% Cr, Ni, Mo, Cu and Sn, and at least some but less than 0.04% Nb, and possibly also at least some but less than 0.06% V. Cold twisting may further improve the properties of the steel.

5 Claims, No Drawings

WELDABLE BAR, ESPECIALLY FOR USE IN REINFORCING CONCRETE

This invention relates to weldable bar or rod, especially for use in reinforcing concrete, and to concrete members or structures including such bar or rod as reinforcement. For simplicity, hereafter in this specification and claims, where we refer to bar only, the term must be read as including, where appropriate, rod.

In the employment of reinforcing bars, welding is being increasingly used. Especially because of the gaining popularity in industrial building of pre-fabricated reinforcing elements, the so-called stitch-welding of crossed reinforcing bars is increasingly taking the place of traditional stitching.

In stitch-welding it is inevitable that locally in the cross-section of the bar there occur changes in structure of the steel which are considered to be undesirable. Especially with reinforcing steel having a carbon-content of between 0.3 and 0.4%, hardening structures which are relatively hard and difficult to deform are produced underneath the stitch-weld as a consequence of the very rapid cooling of that zone of the bar material which is affected by the heat from the stitch-weld.

It is of importance that the carbon-content is sufficiently reduced that the hardness, and hence the degree of brittleness, of the heat-affected zone is acceptable having regard to the intended application of welded concrete-reinforcing bar in a concrete structure.

Though the requirements to be met in respect of strength and stress capacity by welded reinforcing bars are still under discussion in various countries, it may be stated that certain minimum requirements as to strength properties, as determined by a drawing test, should be satisfied and that rupture should occur outside the welded zone, or else that upon rupture near the welding zone a yield capacity of at least 5% uniform elongation outside the welding zone is achieved. This is based upon the consideration that 2 to 3% uniform elongation in the steel is amply sufficient for the rotation capacity of the complete structure which may eventually be required, and further that when such a stress occurs the compressed side of the concrete has collapsed already. Also, in testing stitch-weldability it is usual to bend the bar with the stitch-weld in the drawing zone, although the value of this test procedure is still uncertain (because it is not a test of the workability of the welded steel). Nevertheless it may be assumed that whether or not the welded steel may be bent around a form or mandrel having a diameter 10 times the diameter of the bar without rupture is a amply sufficient criterion for judging the stitch-weldability, as in this test the heat-affected zone is subjected to a yet higher percentage of elongation than is the case in a drawing test to rupture. This bending test can however only realistically be used as a control test to be performed in the practice only on site and it is not to be regarded as an absolute norm.

In the production of high-quality reinforcing steels having FeB 40–50 (lower yield point 40 to 50 kg/mm$^2$) use is increasingly being made of small quantities of alloying elements which give rise to an increase of tensile strength as a result of so-called precipitation-hardening.

It is known from Dutch patent application No. 71.09345 to keep the carbon-percentage relatively low by the addition of V and/or Nb, combined with extra N (at least 0.01%). In particular, naturally aged steel of FeB 40–50 is obtained from SiAl-killed steels having 0.10 to 0.22% C; 0.6 to 1.4% Mn; 0.15 to 0.30% Si; 0 to 0.3% Al; 0.015 to 0.030% N; 0 to 0.03% Nb and 0.02 to 0.20% V.

Dutch patent application No. 71.17490 discloses a steel of FeB 50, strengthened by alloying obtained from a SiAl-killed steel having up to 0.20% V; up to 1.50% Mn, and up to 0.20% Nb + V or up to 0.10% Nb or V separately.

A known method for preparing a high-quality stitch-weldable renforcing steel involves strengthening by deformation, e.g. cold twisting, which enables the carbon-percentage to be kept low because the required increase of tensile strength is obtained entirely by the cold deformation. In view of the increasing costs of such a labour-intensive after-treatment of the reinforcing bars, the use of cold twisting should for any required strength be separately compared with the costs of extra alloying.

In British Patent Specification No. 1,201,031 the achievement of both increased tensile-strength by precipitation hardening through the use of Nb and of cold deformation by twisting are mentioned, though exclusively in combination with an artificial ageing of the material after cold deformation. This in essence results in a combined precipitation hardening and stress-ageing. The specification discloses a Si-killed steel having 0.20 to 0.30% C; 1.0 to 1.5% Mn; 0.2 to 0.5% Si and 0.01 to 0.10 Nb. Especially it is said in this specification that high tensile strength properties (up to FeB 60) may be obtained, though there is no mention of any weldability properties.

Dutch patent specification No. 64.04359 also discloses a technique for increasing tensile strength by precipitation-hardening through a combined Nb addition and strengthening by cold twisting. In this Si-semi-killed reinforcing steel of quality FeB 50 is used having 0.10 to 0.20% C; 0.50 to 1.20% Mn; 0.02 to 0.10% Si; 0.015 to 0.10% Nb, and having good yield and weldability properties.

For specific application as high quality and stitch-weldable reinforcing bar, these above-mentioned steels are less than well-suited, having regard to the desiderata of minimum cost price and a just sufficient weldability, in particular stitch-weldability.

According to the invention there is provided weldable bar, consisting of a Si-semi-killed BOF-steel containing not less than 0.18% and not more than 0.29% C, preferably from 0.21 to 0.27% C, not less than 1.20% and not more than 1.50% Mn, less than 0.1% Si, less than 0.01% Al, less than 0.005% N, less than 0.05% P, less than 0.05% S, in total less than 0.15% Cr, Ni, Mo, Cu and Sn, and at least some but less than 0.04% Nb.

The steel may further contain at least some but less than 0.06% V.

This use of semi-killed steel, as compared with the known and above described killed steels, may provide advantages such as a considerably reduced cost price, resulting from about 10% increased ingot efficiency, and the possibility of not having to use so-called hot tops. Furthermore it has been found that in order to obtain the desired properties of weldability, especially stitch weldability, a restriction of the carbon-content to a maximum of 0.29% is sufficient. This results in the advantage that for alloy-strengthened stitch-weldable FeB 40–42 steel the addition of expensive alloying elements (especially V) can be kept considerably lower than is the case for the known reinforcement steels.

According to the invention in another aspect, there is provided concrete, e.g. in a concrete member or structure, containing as reinforcement bar as above described in accordance with the invention, especially at least two lengths of such bar welded together.

The invention also extends to steel having the specification set out above in respect of the bar of the invention. The steel is preferably naturally aged and may be FeB 40–42.

For use as stitch-weldable bar, steel of higher tensile strength, e.g. FeB 50, may be obtained by cold twisting of the FeB 40–42 steel to distorted or twisted steel, which for a steel of the same tensile strength may be cheaper than the production of alloy-strengthened steels having increased amounts of alloying elements, such as V and N.

The invention will now be illustrated by the following Examples of steel bars embodying the invention. The steels described are Si-semi-killed BOF steels.

EXAMPLE I

Stitch-weldable FeB 40–42, naturally aged, $\phi$ 16 mm.

Analysis 0.26% C; 1.40% Mn; 0.03% Si; 0.015% P; 0.014% S; less than 0.01% Al; less than 0.005% N; $\Sigma$(Cr, Ni, Mo, Cu, Sn) < 0.1%; 0.03% Nb.

Mechanical properties $\sigma_v = 42$ kg/mm$^2$; $\sigma_B = 57$ kg/mm$^2$; Adp-5 = 30%

Stitch-weldability

Drawing tests: rupture outside the welding zone Bending tests (stitch-welds): no rupture of the bar on bending around a form with a diameter 10 times the diameter of the bar.

EXAMPLE II

Stitch-weldable FeB 50, twisted, $\phi$ 16 mm. The same material was selected as in Example I (FeB 40–42) cold twisted with a torsion degree of 10 times the diameter of the bar.

Analysis

Same as example I.

Mechanical properties 0.2 = 54 kg/mm$^2$; B = 61 kg/mm$^2$; Adp 5 = 22%

Stitch-weldability

Drawing tests: rupture outside the welding zone. Bending tests (stitch-welds): no rupture of the bar upon bending around a form with a diameter 10 times the diameter of the bar.

EXAMPLE III

Stitch-weldable FeB 40–42, naturally aged, $\phi$ 22 mm.

Analysis 0.22% C; 1.35% Mn; 0.04% Si; 0.016% P; 0.012% S; less than 0.01% Al; less than 0.005% N; $\Sigma$(Cr, Ni, Mo, Cu, Sn) < 0.1%; 0.03% Nb; 0.04% V.

Mechanical properties $\sigma_v = 43$ kg/mm$^2$; B = 57 kg/mm$^2$; Adp-5 = 30%

Stitch-weldability

Drawing tests: rupture outside welding zone. Bending tests (stitch-welds): no rupture of the bar upon bending around a form with a diameter 10 times the diameter of the bar.

EXAMPLE IV

Stitch-weldable FeB 50, twisted, $\phi$ 22 mm

Analysis

Steel as in Example III. Cold twisted with a degree of torsion 10 times diameter of the bar.

Mechanical properties 0.2 = 54 kg/mm$^2$; B = 60 kg/mm$^2$; Adp-5 = 20%

Stitch-weldability

Drawing tests: rupture outside the welding zone. Bending tests (stitch-welds): no rupture of the bar upon bending around a form with a diameter 10 times the diameter of the bar.

Since, when rolled, thin bars (up to 20 mm $\phi$) cool down more quickly than thick material, it is desirable, in order to obtain the same tensile strength properties, for thicker material (between 20 and 40 mm $\phi$), apart from adding between 0 to 0.04% Nb, also to add between 0 and 0.06% V, as in Examples III and IV.

What we claim is:

1. A hot rolled air cooled weldable bar, consisting of a Si-semi-killed BOF-steel containing not less than 0.18% and not more than 0.29% C, not less than 1.20% and not more than 1.50% Mn, less than 0.1% Si, less than 0.01% Al, less than 0.005% N, less than 0.05% P, less than 0.05% S, in total less than 0.15% Cr, Ni, Mo, Cu and Sn, and at least some but less than 0.04% Nb.

2. Weldable bar according to claim 1 wherein the steel further contains at least some but less than 0.06% V.

3. Weldable bar according to claim 1 wherein the steel contains not less than 0.21% and not more than 0.27% C.

4. Weldable bar according to claim 3, wherein the steel contains 0.26% C, 1.40% Mn, 0.03% Si, 0.015% P, 0.014% S, less than 0.01% Al, less than 0.005% N, in total less than 0.1% Cr, Ni, Mo, Cu and Sn, and 0.03% Nb.

5. Weldable bar according to claim 3 wherein the steel contains 0.22% C, 1.35% Mn, 0.04% Si, 0.016% P, 0.012% S, less than 0.01% Al, less than 0.005% N, in total less than 0.1% Cr, Ni, Mo, Cu and Sn, 0.03% Nb and 0.04% V.

* * * * *